United States Patent [19]

Nishida

[11] Patent Number: 5,013,226

[45] Date of Patent: May 7, 1991

[54] ROTATING SCROLL MACHINE WITH BALANCE WEIGHTS

[75] Inventor: Mitsuhiro Nishida, Fukuoka, Japan

[73] Assignee: Mitsubishi Denki K. K., Tokyo, Japan

[21] Appl. No.: 397,626

[22] Filed: Aug. 24, 1989

Related U.S. Application Data

[63] Continuation-in-part of Ser. No. 219,419, Jul. 15, 1988, abandoned.

[30] Foreign Application Priority Data

Jul. 16, 1987 [JP] Japan ..... 62-179358

[51] Int. Cl.[5] ..... F01C 1/04; F01C 21/00

[52] U.S. Cl. ..... 418/55.1; 418/151

[58] Field of Search ..... 418/55 R, 55 A, 151, 418/188, 55.1, 55.2

[56] References Cited

U.S. PATENT DOCUMENTS 4,735,559 4/1988 Morishita et al. ..... 418/151

FOREIGN PATENT DOCUMENTS 61-126095 8/1985 Japan .

*Primary Examiner*—John J. Vrablik

*Attorney, Agent, or Firm*—Sughrue, Mion, Zinn, Macpeak & Seas

[57] ABSTRACT

A scroll type machine having a driving scroll to be driven by a driving source and a driven scroll to be rotated with a rotation center eccentric with respect to a rotation center of said driving scroll in synchronism with the driving scroll is characterized by having a balance weight attached to one of opposite peripheral portions of a circular disc portion of said driving scroll or said driven scroll and a dummy weight attached to the other peripheral portion of said circular portion.

3 Claims, 4 Drawing Sheets

ROTATING SCROLL MACHINE WITH BALANCE WEIGHTS

This is a continuation-in-part of application Ser. No. 07/219,419, filed 7/15/88, abandoned.

BACKGROUND OF THE INVENTION

The present invention relates to a scroll machine and, particularly, an improvement of such scroll machine utilizing a principle of a scroll compressor of a rotating driving scroll and a rotating driven scroll.

The principle of the scroll compressor is well known as a kind of volume compression type in which compression effect is obtained by a combination of a pair of convolute protrusions. One of the convolute protrusions is usually stationary and the other is rotated to compress fluid. On the other hand, the operational principle of the so-called full rotation type scroll compressor in which both scrolls are rotated about their rotation centers is also well known as disclosed in, for example, U.S. Pat. No. 2,475,247.

FIG. 5 is an illustration showing the principle of the full rotation type scroll compressor, in which a driving scroll 1 is rotated about a center axis $O_1$ by a driving source such as electric motor, engine or turbine. A driven scroll 2 is also rotated about its center axis $O_2$ in synchronism with the driving scroll 1. A compression chamber 3 is moved inwardly during rotations of these scrolls to reduce its volume to thereby increase a pressure of gas therein, a resultant high pressure gas being discharged from a discharge port 2*c*.

In a state (a) of the scroll compressor shown in FIG. 5 in which a rotation angle is 0°, gas is introduced into the compression chamber 3. With a further rotation from 0° to 360°, the compression chamber 3 moves toward the center gradually as shown by states (b) to (d) to reduce its volume. During this movement, radial seal portions S between convolute protrusions 1*a* and 2*a* of the scrolls 1 and 2 are stationary and arranged along a radial straight line.

As is well known, since a gravity center of the convolute protrusion of each scroll is around an end of its convolution, an imbalance is compensated by forming a recess in a circular plate portion as shown in Japanese Utility Model application Laid-Open No. 126095/1986.

The formation of such recess requires a relatively complicated milling, causing a scroll machine to be expensive.

SUMMARY OF THE INVENTION

An object of the present invention is to provide a scroll machine which can be manufactured within a time much shorter than that required to manufacture the conventional scroll machine.

A scroll machine according to the present invention comprises a driving scroll to be driven by a driving source, a driven scroll adapted to rotate around a center which is eccentric with respect to a rotation center of the driving scroll in synchronism with the latter, a balance weight disposed in one of symmetric positions on an outer periphery of a circular disc of either of the driving and the driven scrolls and a dummy weight in the other of the symmetric positions of the circular disc. With such construction, a compensation for imbalance is facilitated.

DETAILED DESCRIPTION OF THE PREFERRED EMBODIMENT

Figure 1:
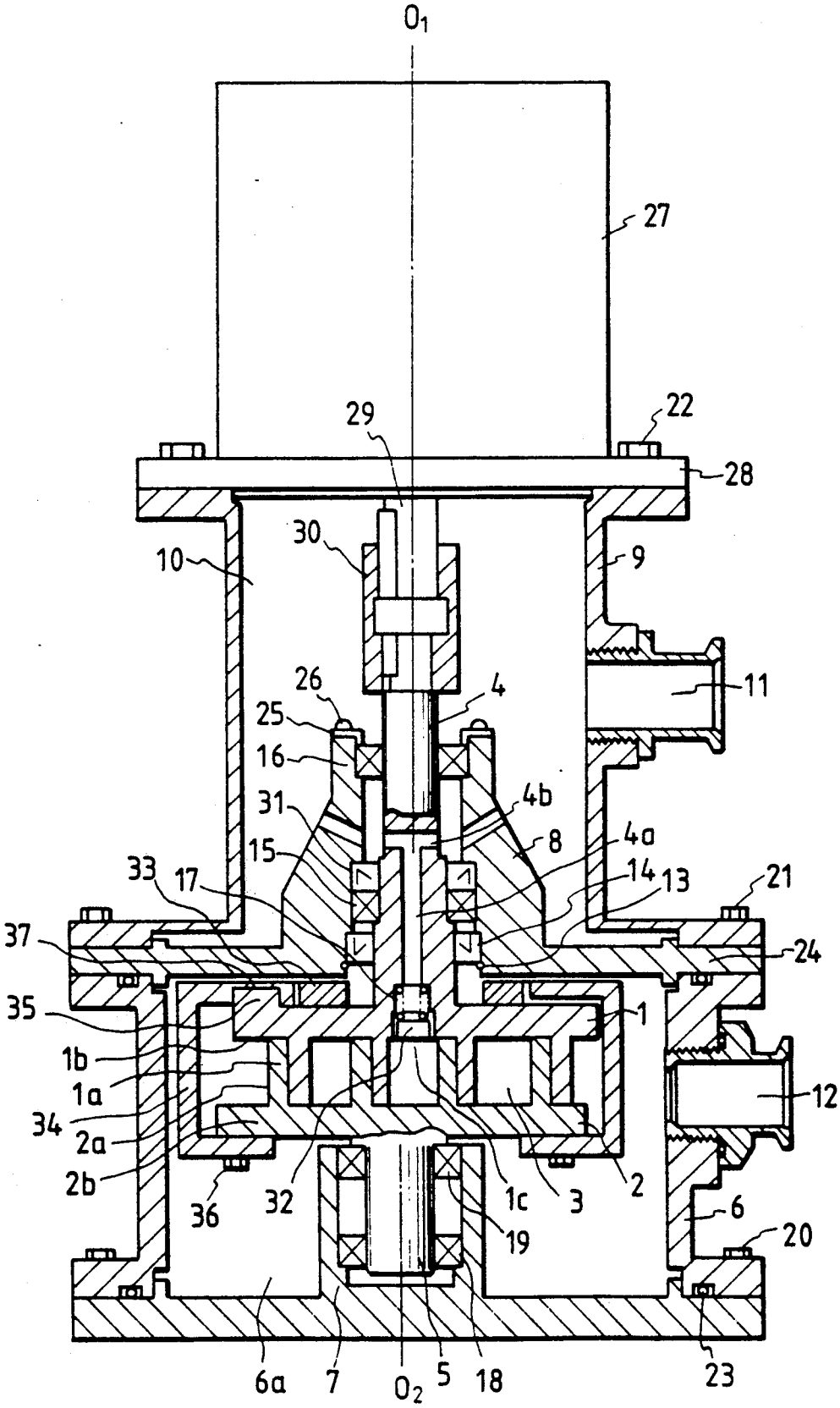
FIG. 1 is a cross section of an embodiment of a scroll pump according to the present invention.
Figure 2:
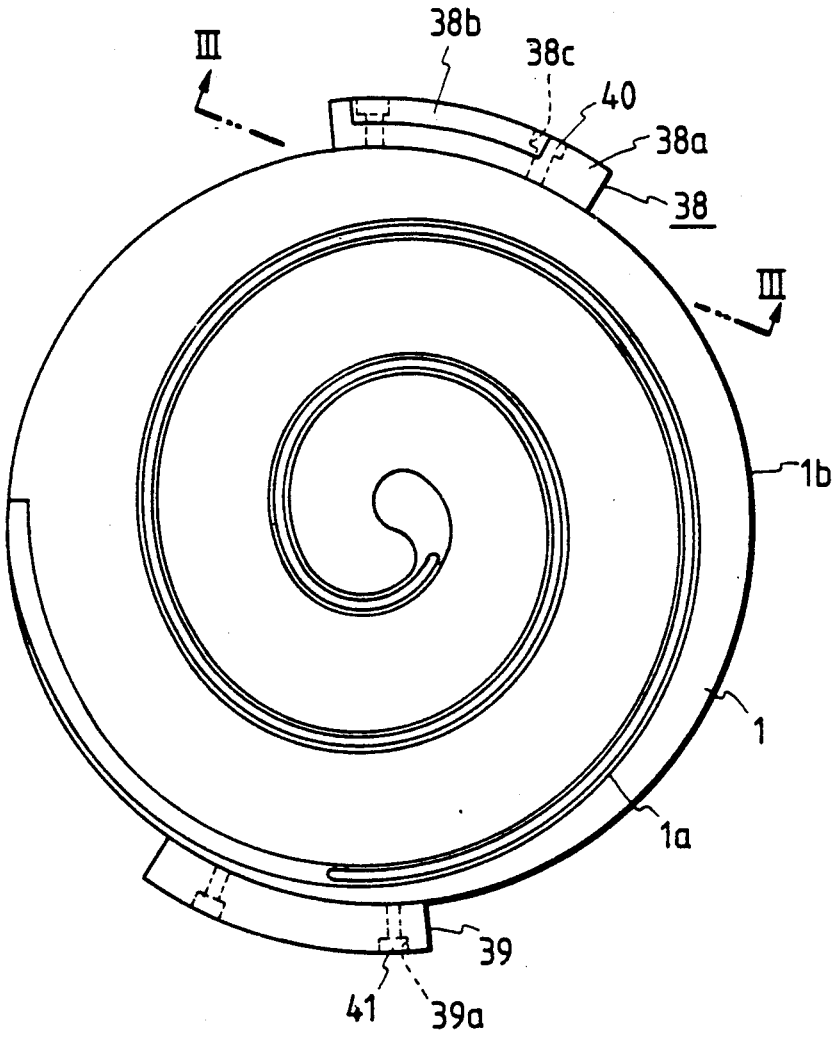
FIG. 2 is a plan view of the pump in FIG. 1.
Figure 3:
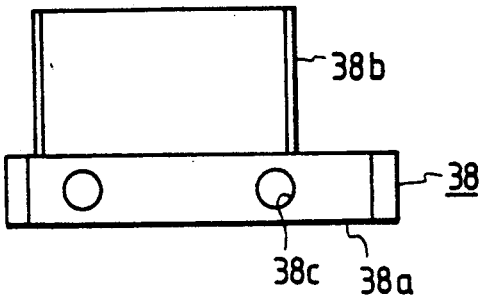
FIG. 3 is a side view taken along a line III—III in FIG. 2 showing a balance weight.
Figure 4:
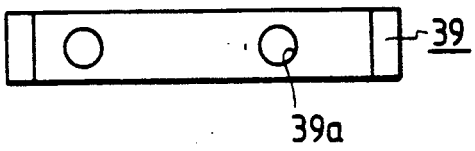
FIG. 4 is a similar view to FIG. 3, showing a dammy weight.

In FIGS. 1 to 4 which show a scroll pump according to an embodiment of the present invention in cross section, reference numeral 1 depicts a driving scroll including a circular disc portion 1*b* having a discharge port 1*c* at a center thereof, a convolute protrusion 1*a* formed integrally on a lower surface thereof and a driving shaft portion 4 provided on an upper surface thereof. Reference numeral 2 depicts a driven scroll including a circular disc portion 2*b*, a scroll portion 2*a* formed on an upper surface of the disc portion 2*b* integrally therewith and a boss 5 extending downwardly from a lower surface thereof. The discharge port 1*c* is connected through a valve 32 biased by a spring 31 to a discharge passage 4*a* extending through the driving shaft portion 4 and then to radially extending discharge passages 4*b*. A reference numeral 6 depicts a cylindrical container forming a suction chamber 6*a* a bottom of which is air-tightly sealed by a bottom plate through an O-ring 23 and bolts 20. The bottom plate is formed with an upright bearing housing 7 which supports the driven scroll 2 through bearings 18 and 19. A reference numeral 8 depicts an upper housing sealingly secured to the container 6 through an O-ring 24 by bolts 21. An annular atmospheric chamber 10 is formed around the upper housing 8, which is opened to atmosphere through a passage 11. The driving shaft 4 is supported by bearings 15 and 16 whose axial movement is restricted by a stopper member 25 fixed to an upper end of the upper housing by bolts 26. Reference numerals 14 and 31 depict seal members, 13 a stopper ring secured to the upper housing 8 to support the seal member 14, 9 an upper container fixed to the upper housing 8 and the container 6 by bolts 21 and defining the annular atmospheric chamber 10 in communication with atmosphere through the passage 11 formed therein.

A driving motor 27 having a flange 28 is mounted on the upper container 9 by bolts 22. A rotary shaft 29 of the motor 27 is connected to the driving shaft 4 through a joint 30. The housing 6 is formed with a suction port 12 to be connected to a utilization means to be evacuated. As shown in FIGS. 6*a* and 6*b*, a joint 33 is positioned in place by a key or a protrusion 35 provided on the driving scroll 1 and arms 34. The arms 34 are fixedly secured to the driven scroll 2 by bolts 36 while the driving scroll 1 is allowed to move relatively within a limited range defined by an engagement of the protrusion 35 thereof with a groove 37 formed in the joint 33.

Figure 6:
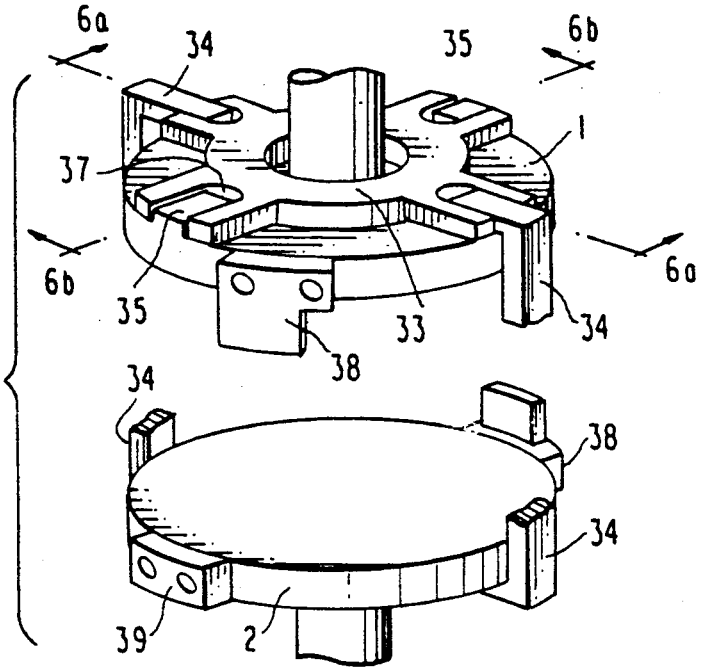
FIG. 6 is a perspective view of the scrolls.
Figure 6A:
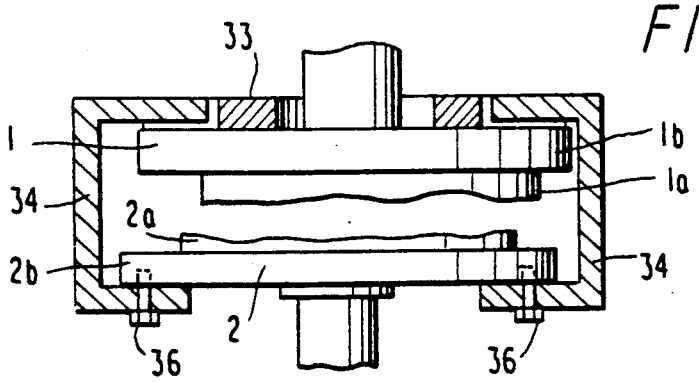
FIGS. 6*a* and 6*b* are sectional views of the scrolls taken along the lines 6a—6a and 6b—6b of FIG. 6, respectively.
Figure 6B:
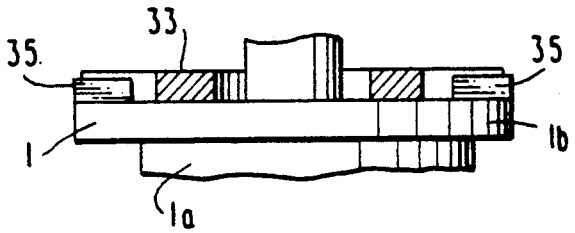

A balance weight 38 and a dummy weight 39 are each attached to both the driving scroll 1 and the driven scroll 2, as shown in FIG. 6. Since the weights are secured to the scrolls in the same manner, the description will be limited to the driving scroll 1, as follows.

A balance weight 38 (FIGS. 2 and 3) is attached to an outer periphery of the circular disc portion 1*b* of the driving scroll 1 and includes a joint portion 38*a* to be attached to a portion of the circular disc portion 1*b* of the scroll 1 which is opposite to a portion of the disc 1*b* in which an outer end of the convolute protrusion 1*a* is positioned, a weight portion 38*b* having weight corresponding to an actual imbalance and mounting holes 38*c* formed therein. A dummy weight 39 having mounting holes 39*a* formed therein is also attached to the opposite side of the circular disc portion 1*b* of the driving scroll 1 and has a similar configuration to the joint portion 38*a* of the balance weight 38 so that it compensates for an imbalance caused by the joint portion 38*a* of the driving scroll 1. The balance weight 38 and the dummy weight 39 are mounted to the circular disc portion 1*b* of the driving scroll 1 by bolts 40 and 41, respectively. In this case, the weight portion 38*b* of the driving scroll 1 is positioned such that it does not contact with the convolute protrusion 2*a* of the driven scroll 2 in operation.

In operation, when the motor 27 rotates, the driving scroll 1 is rotated thereby around its center axis $O_1$ and the driven scroll 2 is rotated thereby around its center axis $O_2$ through the joint 33. In this case, it is set by the joint 33 and the arms 34 that the driven scroll 2 is rotated with an exact angle of 180° with respect to the driving scroll 1 so that contact points between the convolute protrusions 1*a* and 2*a* of the scrolls 1 and 2 are completely intimate without gap to completely seal the compression chamber 3 to thereby improve the degree of vacuum to be established. The balance weights 38 and the dummy weights 39 attached to both the driving scroll 1 and the driven scroll 2 contribute to eliminate any imbalance caused by the rotating scrolls.

Figure 5:
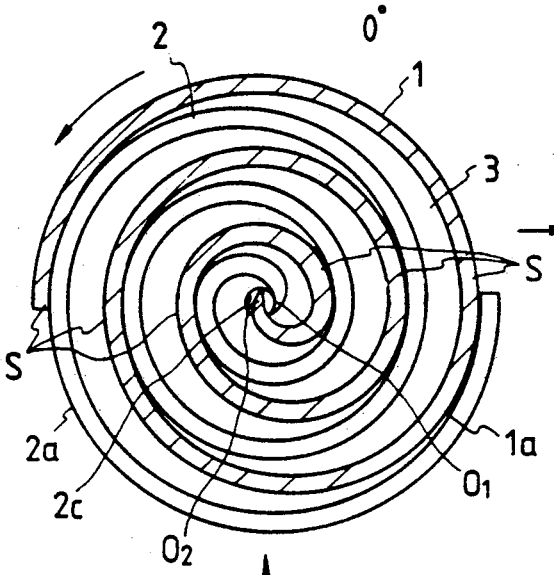
FIGS. 5(*a*) to 5(*d*) illustrate an operation of a conventional scroll machine.
Figure 5:
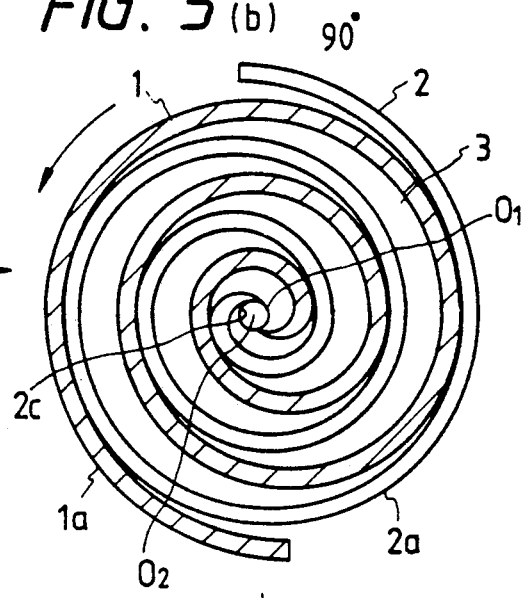
Figure 5:
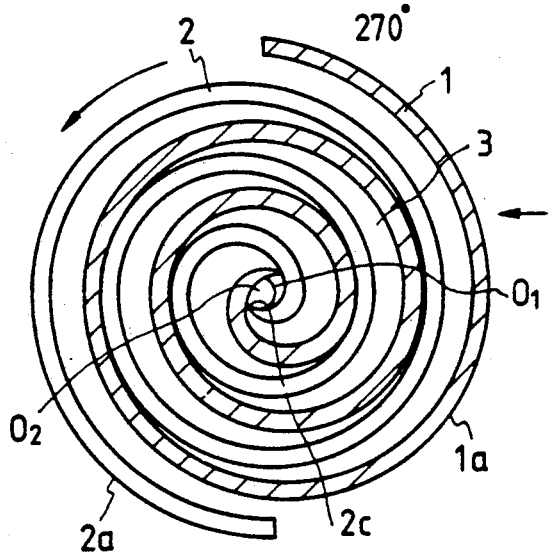
Figure 5:
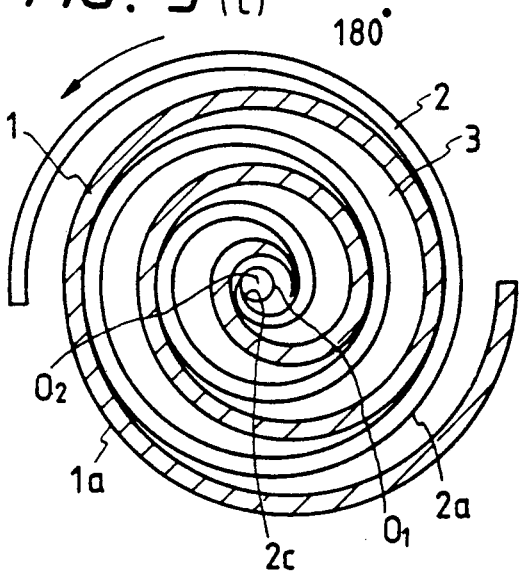

The compression of fluid is performed by the scrolls 1 and 2 in the same manner as in the conventional machine such as shown in FIG. 5. That is, gas is introduced through the suction port 12 connected to the utilization means to be evacuated to the suction chamber 6*a* and then to the compression chamber 3 and compressed therein while it is being moved inwardly due to the rotations of the scrolls 1 and 2. Compressed gas pushes up the valve 32 in the discharge port 1*c* and passes through the valve 32 and the discharge passages 4*b* to the atomospheric chamber 10 from which it is discharged through the passage 11.

As to the balancing, there are two ways in which to carry out balancing, one being performed in a position on a line passing through the center of gravity of the scroll portion, and the other being performed in another position. The present invention employs the first technique, or "direct balancing", and U.S. Pat. No. 4,735,559 (Morishita et al.) employs the second technique.

The scroll portion (involute portion) is asymmetrical and imbalanced. In order to make the scroll portions symmetrical, i.e., balanced, it is necessary to arrange a suitable weight in a position on a horizontal line passing through the center of gravity of the scroll portion. In order to arrange the weight in such a position, a mounting member attached to the scroll base and for supporting the weight is necessary. Since the mounting member produces a new imbalance problem, a dummy weight is attached to a position on the scroll base which is symmetrical to the mounting. The dummy weight is substantially identical to the mounting. The size of the weight is determined from the x, y and z values of the gravity center and weight of the scroll portions.

Thus, with the use of the dummy weight, it is possible to mount the weight at a position on the gravity center line and along an imaginary extension of the involute. In this case, the mounting position of the weight must be outside the other scroll to avoid a collision therebetween. That is, it must be mounted outside the extension of the involute.

The second technique, which Morishita, et al. disclose, is to mount a balance weight in a position other than the position described above with respect to the first technique, to achieve a balance of the moment. Although this method requires no dummy weight, the preciseness of balancing achieved by this method is poor when compared with the first method.

In the present invention, the weight portion 38*b* of the balance weight 38 opposes the convolute protrusions 1*a* and 2*a* and, therefore, a correction of imbalance can be performed in substantially the same vertical level as the convolute protrusions 1*a* and 2*a*, causing a determination of amount of correction to be facilitated as a result of which the accuracy of correction is improved.

The balance weights 38 and/or the dummy weights 39 may be produced by dividing a preliminarily machined ring shaped member into a suitable number of sectors. Therefore, the manufacture of the balance weights and the dummy weights is performed easily and rapidly.

As mentioned, according to the present invention, any imbalance of the driving scroll and the drive scroll is removed by merely attaching the balance weights and the dummy weights which can be easily manufactured.

What is claimed is:

1. A scroll machine, comprising:

a driving scroll rotatably disposed about a first axis;

a driven scroll rotatably disposed about a second axis, said driven scroll being driven by said driving scroll, said second axis being eccentric to said first axis, each of said driving scroll and said driven scroll including a disc portion and a scroll portion, said scroll portions being respectively disposed on one side of said disc portions, wherein a balance weight is attached to a first peripheral portion of said disc portion of said driven scroll and said driving scroll such that said balance weight projects toward said one side of said disc portion so as to be disposed radially adjacent said scroll portion and a dummy weight is attached to a second peripheral portion of said disc portion opposite said first peripheral portion.

2. The scroll machine as claimed in claim 1, wherein said balance weight includes a joint portion to be connected to said first peripheral portion of said circular disc portion and a weight portion corresponding to the portion of said balance weight that projects toward said one side for correcting an actual amount of imbalance and said dummy weight is identical to said joint portion to compensate for an imbalance caused by said joint portion of said balance weight.

3. The scroll machine as claimed in claim 2, wherein said joint portion of said balance weight is integral with said weight portion thereof.

* * * * *